US007909786B2

(12) United States Patent
Bonnefin et al.

(10) Patent No.: US 7,909,786 B2
(45) Date of Patent: Mar. 22, 2011

(54) COMPRESSION DEVICE FOR THE LIMB

(75) Inventors: Wayne Lee Bonnefin, Chester (GB); David Geoffrey Wild, Wirral (GB); Simon Mark Adams, Flintshire (GB); Jose Arsenio Fernandez, Bridgend (GB); Mats Christiansson, Gothenburg (SE)

(73) Assignee: ConvaTec Technologies Inc., Las Vegas, NV (US)

( * ) Notice: Subject to any disclaimer, the term of this patent is extended or adjusted under 35 U.S.C. 154(b) by 1249 days.

(21) Appl. No.: 11/459,036

(22) Filed: Jul. 21, 2006

(65) Prior Publication Data

US 2007/0049853 A1 Mar. 1, 2007

(30) Foreign Application Priority Data

Jul. 21, 2005 (GB) ..... 0515040.4

(51) Int. Cl.
*A61H 9/00* (2006.01)

(52) U.S. Cl. .. 601/151; 601/148; 601/149; 601/DIG. 20

(58) Field of Classification Search ..... 601/148, 601/149, 150, 151, 152
See application file for complete search history.

(56) References Cited

U.S. PATENT DOCUMENTS

| | | | | |
|---|---|---|---|---|
| 4,396,010 | A * | 8/1983 | Arkans | 601/152 |
| 5,591,200 | A | 1/1997 | Cone | |
| 5,951,502 | A * | 9/1999 | Peeler et al. | 601/149 |
| 6,926,617 | B2 | 10/2001 | Peeler | |
| 6,387,065 | B1 | 5/2002 | Tumey | |
| 6,440,093 | B1 | 8/2002 | McEwen | |
| 6,786,879 | B1 | 9/2004 | Bolam | |
| 2002/0042583 | A1 | 4/2002 | Barak | |
| 2004/0106884 | A1 | 6/2004 | Bolam | |
| 2004/0111048 | A1 | 6/2004 | Jensen | |

FOREIGN PATENT DOCUMENTS

WO WO02055005 7/2002

* cited by examiner

*Primary Examiner* — Quang D Thanh
(74) *Attorney, Agent, or Firm* — John M. Kilcoyne

(57) ABSTRACT

A compression device for a limb of a patient comprises an inflatable sleeve arranged to surround the limb and a conduit attached to the sleeve arranged to deliver fluid to the sleeve. The compression device also comprises a control system arranged to control fluid flow in the device and a memory arranged to store gathered data relating to use of the device.

20 Claims, 5 Drawing Sheets

COMPRESSION DEVICE FOR THE LIMB

This invention relates to a compression device for the limb and particularly to a device for use on the leg. For example, the device may be used for compression therapy used in the treatment of venous leg ulcers.

BACKGROUND OF THE INVENTION

Various compression devices are known for applying compressive pressure to a patient's limb. These types of devices are used to assist mainly in the prevention of deep vein thrombosis (DVT), vascular disorders and the reduction of oedema. U.S. Patent Application No. 2004/0111 048 (Jensen, et al.) and U.S. Pat. No. 6,786,879 (KCI Licensing Inc.) disclose such devices.

Compression therapy is used in the treatment of venous leg ulcers. The treatment relies on the compression achieving a reduction in oedema and improved return of blood via the venous system. This, in turn, reduces the residence time for blood supplied to the lower limb and the severity of ischaemic episodes within the limb that can result in tissue breakdown.

Compression of the limb in the treatment of venous leg ulcers is most usually achieved by the use of elastic bandages. Elastic bandages have the advantages that the patient can be mobile; can be treated at home; and that once applied by a health care professional, any removal or interference may be possible to detect. Elastic bandages do, however, have many disadvantages: they can work loose; the pressure generated by the bandage on the limb is not measured and depends on the level of skill of the health care professional applying the bandage; the level of compression is also affected by the circumference of the limb; the bandage cannot be removed and reapplied by the patient, for instance, for bathing; and many patients find them unsightly, uncomfortable, hot or painful.

Compression of the limb in the treatment of venous leg ulcers can also be achieved by the use of compression stockings, although they are most often used in the prevention of leg ulcers, for instance, in the prevention of recurrence after an active leg ulcer has healed. Compression stockings have many of the advantages of elastic bandages: they can be used at home and the patient can be mobile. They, however, have some disadvantages; they are difficult to apply as the narrow ankle part has to be pulled over the heel; compliance with treatment is difficult to monitor as the patient may be able to remove and replace the stocking themselves; and patients can find them uncomfortable.

Compression of the limb can also be achieved by a pneumatic compression device. As venous leg ulcers are most usually treated at home or in the community and the known compression devices are large, heavy and require professional supervision, their adoption for such treatment has not been widespread. The known devices, used previously, apply pressure to the limb through a thick cuff or cuffs which affect patient mobility and are aesthetically unacceptable to many patients. The pump which produces the compression is large and heavy and can supply fluid to the cuffs through many pipes. These characteristics make the known devices unsuitable for domestic use.

SUMMARY OF THE INVENTION

We have developed a pneumatic compression device more suitable for home use.

Pneumatic compression devices have the following advantages: they provide an effective treatment; while deflated, the inflatable cuff or cuffs are easy to apply to the patient's leg; and the pressure is more readily controlled and monitored.

However, as with all of the previously referenced devices, compliance with treatment can be a problem as a patient treated at home or in the community may remove the device, for any of the reasons mentioned, which can result in insufficient usage of the device and failure to follow a compression therapy schedule prescribed by a healthcare professional. This can lead to a longer healing time for the patient.

The present invention provides for a compression device for a limb of a patient comprising: an inflatable sleeve arranged to surround the limb, a conduit attached to the sleeve arranged to deliver fluid to the sleeve, a control system arranged to control flow of fluid in the device and a memory arranged to store gathered data relating to use of the device.

Advantageously, such a compression device allows direct monitoring of use of the device by, for example, a healthcare professional. A patient may only see a healthcare professional once or twice a week and this device provides the healthcare professional with independent knowledge of the usage details which the patient may otherwise be reluctant to provide or may not be able to provide accurately. Problems associated with cases of poor usage of the compression device can thus be more easily identified.

The control system comprises a pump and a controller unit. The control system, further comprises a display device arranged to provide a display dependent upon the gathered data. Preferably, the controller unit is portable and wearable and, more preferably, it is attached to the conduit. The controller unit includes a display which may be in the form of a liquid crystal display (LCD) or other similar type display. Alternatively, the display may be part of a remote device such as a personal computer with which the controller can communicate, e.g., by cable connection, radio frequency, infrared or other similar means of communication.

The compression device comprises at least one pressure sensor arranged to measure the pressure exerted by the compression device. The sensor or sensors are attached to the sleeve and located between the sleeve and the limb, the sensor(s) provide readings of the pressure experienced by the limb due to the inflation of the sleeve by the controller. The pressure sensor may be a contact pressure sensor or other similar type sensor.

We have found that monitoring the actual pressure experienced by the limb due to the compression device enables the compression device to provide a predetermined compression profile to the limb. The predetermined compression profile is selected by the health care professional to cater for the patient's condition. For example, a patient with lymphodema may require a different level of compression than a patient with a healed leg ulcer. The sensor also allows the compression device to increase or decrease the pressure on a particular part of the limb to give the predetermined compression profile while the compression device is in use. This alleviates the problem of pressure difference experienced with the use of elastic bandages where the pressure depends on the tension in the bandage, the amount of overlap and the shape of the leg of the patient.

The pressure sensor is used to measure the fluid pressure inside the sleeve, thus providing a measure of the pressure exerted by the sleeve. The sleeve has a valve associated with it and the control system is arranged to control operation of the valve and, thereby, inflation/deflation of the sleeve. The pressure sensors associated with the sleeve are, preferably, located between the valve and the sleeve. The pressure sensor is, preferably, a fluid pressure sensor arranged to measure fluid pressure preferably in the line between the valve and sleeve.

The sleeve comprises one or more individually inflatable cells. Preferably, a sensor is associated with each cell to monitor the pressure experienced by the limb due to pressure from that cell. For example, each sleeve may have a valve associated with it and the controller is arranged to control operation of the valve and, therefore, inflation/deflation of each cell. The pressure sensors associated with each cell are, preferably, located between the valve and the cell. This allows the compression device to precisely control the pressure in each cell and, thus, comply with the predetermined compression profile. It also allows the compression device to operate an intermittent pneumatic compression.

The memory is arranged to store data relating to any one or more of: the duration of use of the compression device, the pressure exerted by the sleeve on the limb and the mode of operation of the device. The memory is also arranged to store data relating to the use of the compression device while it is in place surrounding the limb. To accomplish this, the control system must first determine whether or not the device is in place surrounding the limb. This may be achieved by having expected data values relating to use of the device stored in the memory for comparison by the control system with gathered data values. For example, when the sleeve is in place on the limb it will have a different inflation profile compared to when it is not in place surrounding the limb. The control system may monitor a change in pressure exerted by the sleeve as it is inflated, e.g., by monitoring the time taken to inflate the sleeve to a predetermined pressure, and this will vary depending upon whether or not the device is in place surrounding a limb. Therefore, by comparing gathered data with expected time and pressure data values, the controller can determine whether or not the sleeve is in place surrounding the limb.

Advantageously, the control system may be arranged to disregard any data gathered when the sleeve is not in place around the limb and this provides more accurate, useful gathered data for analysis.

Preferably, when the sleeve is not in place surrounding the limb, the control system is arranged to shut off delivery of fluid through the sleeve and preferably deflate the sleeve. Advantageously, this provides a safety mechanism against unnecessary inflation or over-inflation of the inflatable sleeve when it is not in place surrounding the limb.

Due to the sensors and monitoring capacity of the compression device, and the microprocessor present in the control system, it is possible to monitor the usage of the compression device by the patient. This is not possible with elastic compression devices. Knowledge of the extent of usage enables the health care professional to prescribe the most suitable treatment for the next stage of healing or prevention.

The capability of the controller to deliver predetermined compression profiles to the limb also enables the health care professional to give the patient some control over his or her treatment. For a chosen treatment regime, the patient can select a high compression or low compression setting. This alleviates the problem of non-compliance in some patients who cannot tolerate the pain of compression bandages or stockings that only provide one compression level. The use of the device on a low setting is preferable to rejection of the treatment altogether.

The compression device may be used for the limb of a mobile patient.

Preferably, the sleeve is low profile and discrete, allowing the patient to use the device while wearing ordinary clothes and shoes.

Preferably, the sleeve comprises a leg cuff and a foot cuff both of which are low profile and discrete. Preferably, the leg and foot cuffs are anatomically shaped to provide compression on those parts of the leg or foot which have the greatest effect on blood flow. This provides the advantage of reducing the overall size of the device and, thus, the profile of the cuff and size and power of the pump. Depending on the shape of the cuffs, it can also reduce discomfort from pressure on bony areas of the limb.

Another aspect of the present invention, provides a method of monitoring use of a compression device for a limb of a patient having an inflatable sleeve arranged to surround the limb, a conduit attached to the sleeve arranged to deliver fluid to the sleeve and a control system arranged to control flow of fluid in the device including the step of storing gathered data relating to use of the device.

Still another aspect of the present invention provides a data carrier carrying software which, when run on a processor of a control system of a compression device, is arranged to monitor use of the compression device according to the method of the second embodiment of the invention.

DETAILED DESCRIPTION OF THE INVENTION

Figure 1:
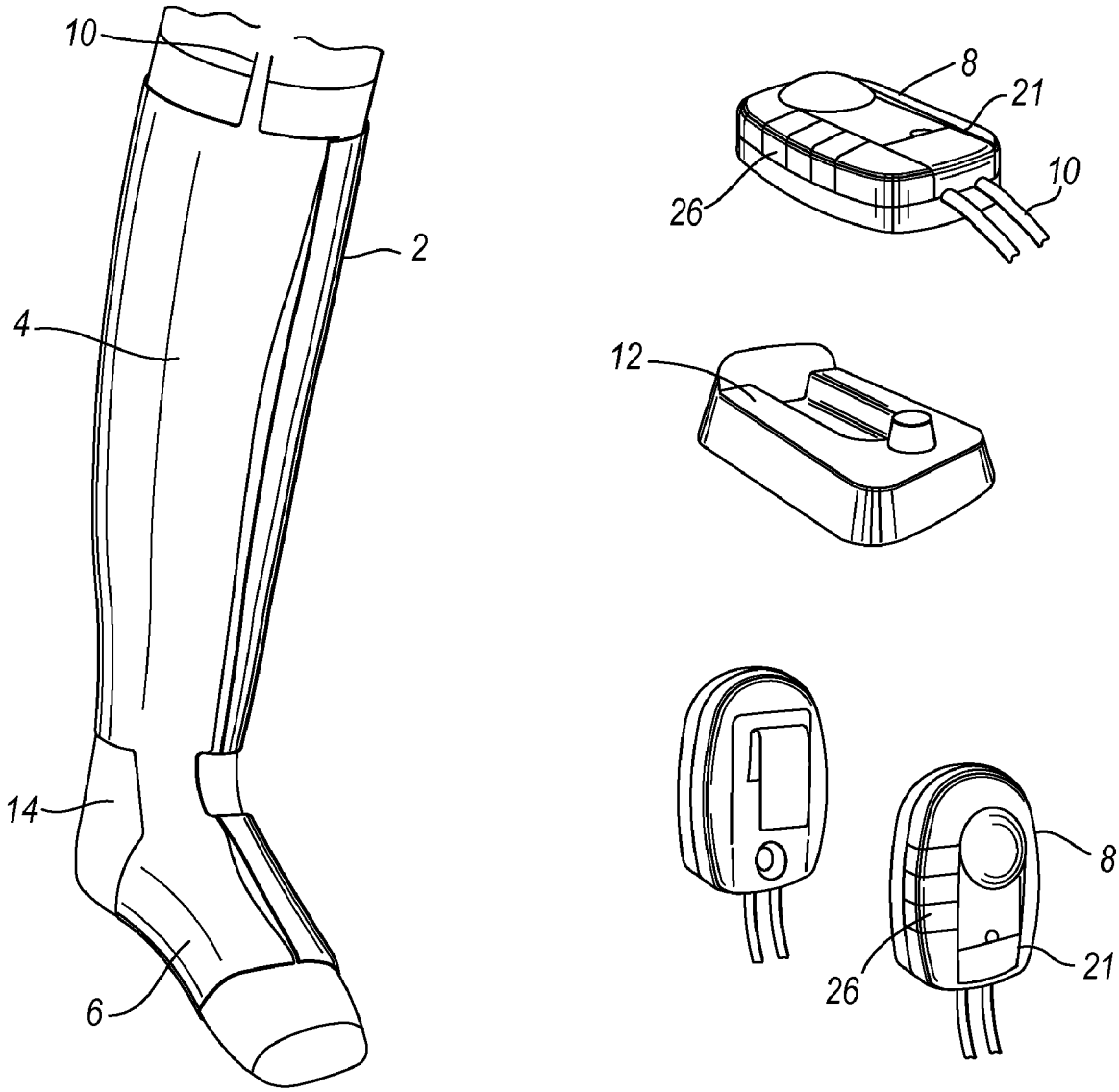
FIG. 1 is a perspective view of the sleeve of a first embodiment of the device on the limb and the controller.
Figure 2:
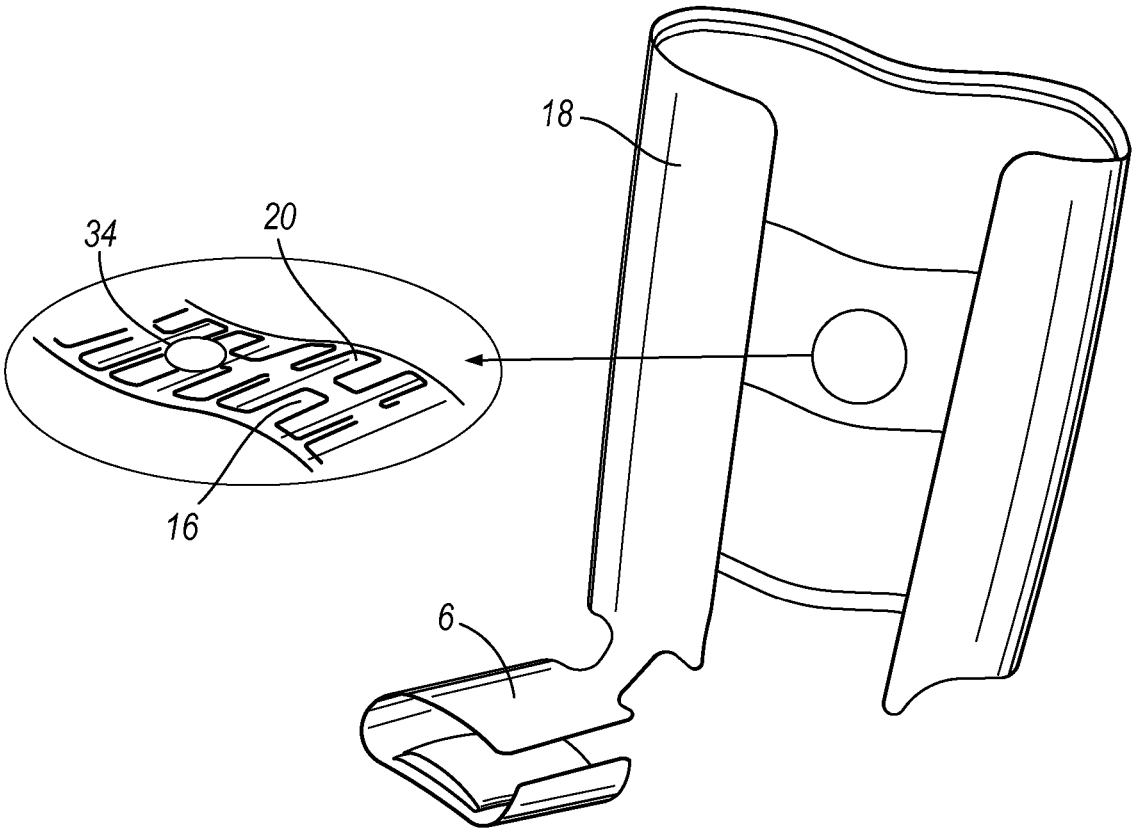
FIG. 2 is a perspective view of the sleeve of the device off the limb and opened up.

In FIG. 1 the compression device of the invention is shown on the leg of a patient in a standing position. The compression device comprises a sleeve 2 having a leg cuff 4 connected to a foot cuff 6. The compression device also comprises a control system housed within a controller unit 8. The sleeve 2 is connected to the controller unit 8 by a conduit 10. The controller unit 8 is a small, hand held unit that may be clipped to the sleeve 2 or to the waistband of the patient's trousers or skirt. The controller unit 8 is battery powered, e.g., by a Lithium battery, and rechargeable so that it can be recharged on a base unit 12. The compression device also comprises an understocking 14 worn between the patient's leg and the sleeve 2. The understocking 14 is present to absorb any moisture from the patient's leg but is not intended to apply compression. The sleeve 2 has an inner surface 16 and an outer surface 18 composed of a durable flexible material that can be sponged clean and is divided into a plurality of cells 20 best seen in FIG. 2.

Figure 3:
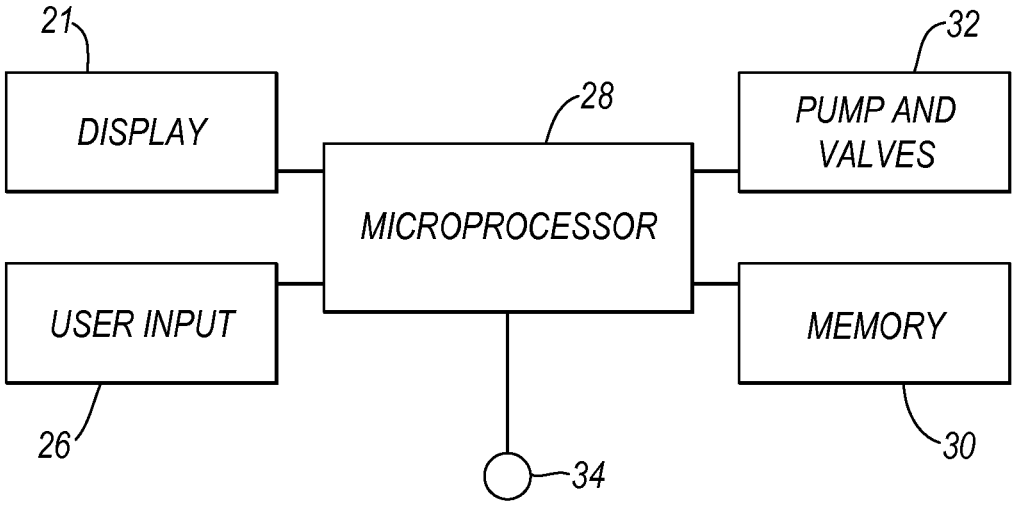
FIG. 3 is a schematic diagram of the functional units of the control system of the device.

The controller unit 8 comprises a display 21, e.g., in the form of an LCD panel. Additionally, the controller unit 8 comprises a user input 26, e.g., in the form of a row of buttons. Referring to FIG. 3, the controller unit 8 comprises a microprocessor 28, and a memory 30. The control system also comprises a pump and valve arrangement 32. A pressure sensor 34 is attached to the sleeve 2 and located between the sleeve 2 and the limb and provides readings of the pressure experienced by the limb due to inflation of the sleeve 2 by the control system. In this embodiment the pressure sensor 34 is a contact pressure sensor. The microprocessor 28 is able to read data from and write data to the memory. Operation of the control system by a user is achieved via the user input 26.

In use, the pressure sensor 34 provides information relating to the pressure exerted by the sleeve 2 on the limb. The microprocessor 28 is able to determine the length of time the sleeve 2 is inflated and in place surrounding the limb. This data is stored in the memory 30. The compression device operates in a continuous pressure mode. In this continuous pressure mode a patient or healthcare professional uses the user input 26 to input a desired constant pressure which is required to be applied to the limb via the sleeve 2. The microprocessor 28 arranges for inflation of the sleeve 2 to the required pressure. The pressure sensor 34 is used to determine when the required pressure has been reached. If, during the course of time, the pressure being exerted by the sleeve 2 on the limb falls below a required level, it is detected by the pressure sensor 34 and the microprocessor 28 communicates with the pump and valve arrangement 32 in order to inflate the sleeve 2 back up to the required level of pressure.

The microprocessor 28 runs a timer program to measure the length of time for which the pressure being applied by the sleeve 2 is at a particular level. This data is stored in the memory 30. Using the user input 26, the user can specify the length of time the sleeve should remain inflated. After this length of time has expired, the microprocessor 28 arranges for deflation of the sleeve 2.

Using the user input 26, the healthcare professional can request details of use of the device to be displayed on the display 21, by, for example, inputting a personal identification number (PIN) or other code.

Figure 4:
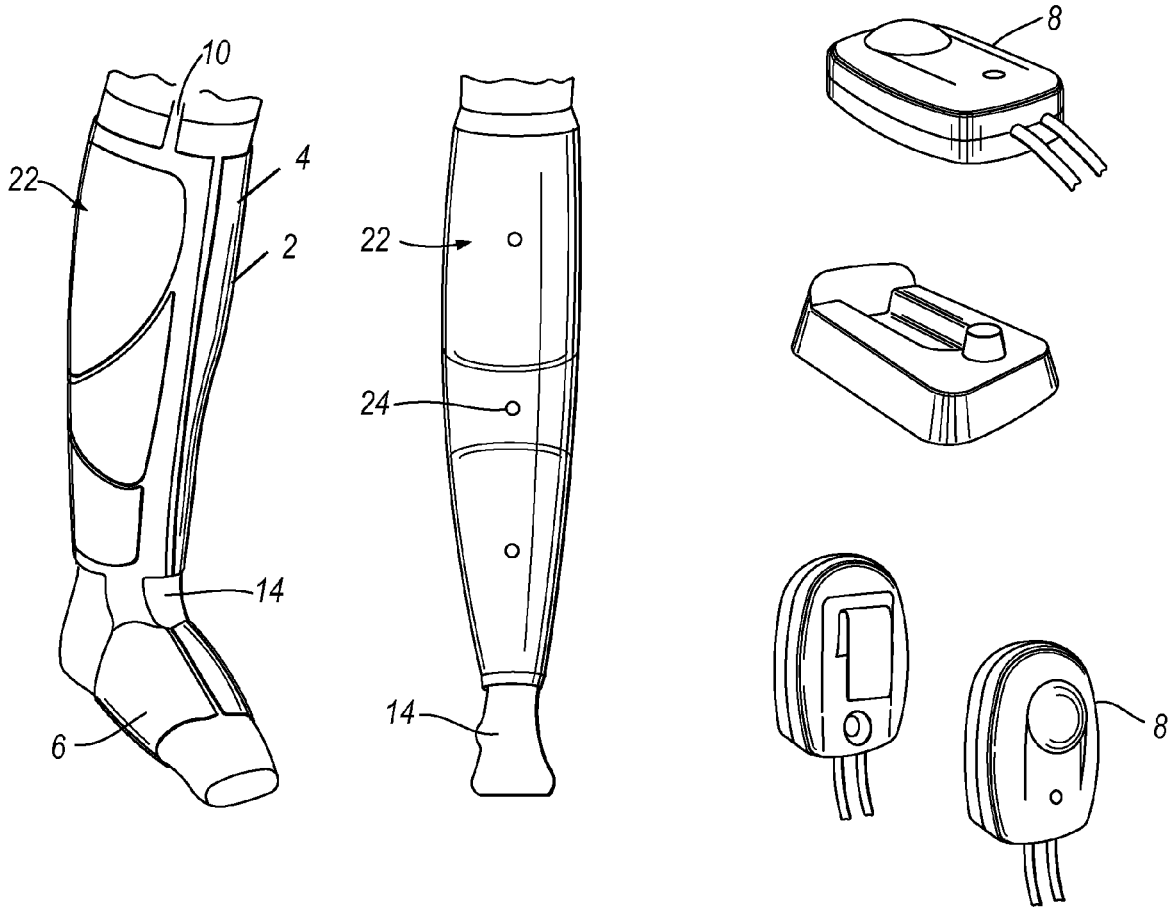
FIG. 4 is a perspective view of the sleeve and controller of a second embodiment of the device on the limb.

FIG. 4 shows a compression device according to a second embodiment of the invention where the leg cuff 4 and foot cuff 6 comprise cells with an anatomical shape 22. Four cells are provided in this embodiment. Each cell is provided with a sensor located centrally in each cell, but on the inside of the sleeve 2 between the sleeve 2 and the leg. In FIG. 4 the sleeve 2 is marked on the outside at a position corresponding to the position of the sensor in the inside of the sleeve 2 at 24. The foot cuff 6 in either embodiment may have a sensor located in a position corresponding to the instep of the foot.

Figure 5A:
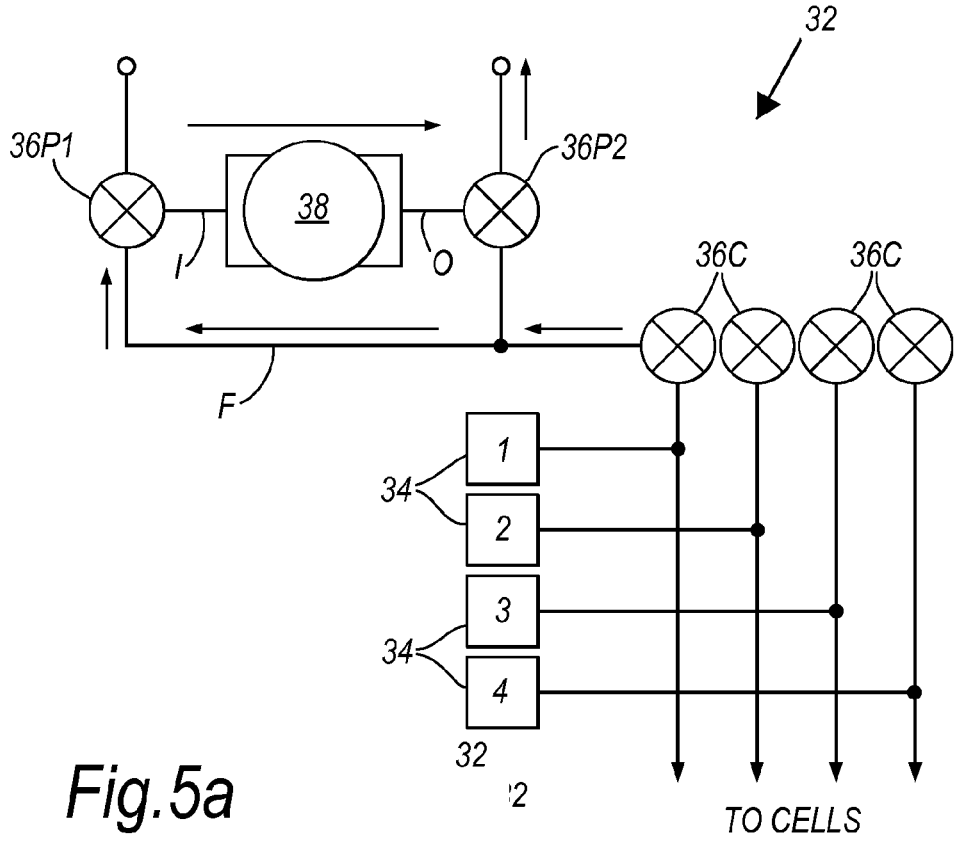
FIGS. 5*a* to 5*c* are schematic diagrams of a pump and valve arrangement of the device of FIG. 4.
Figure 5B:
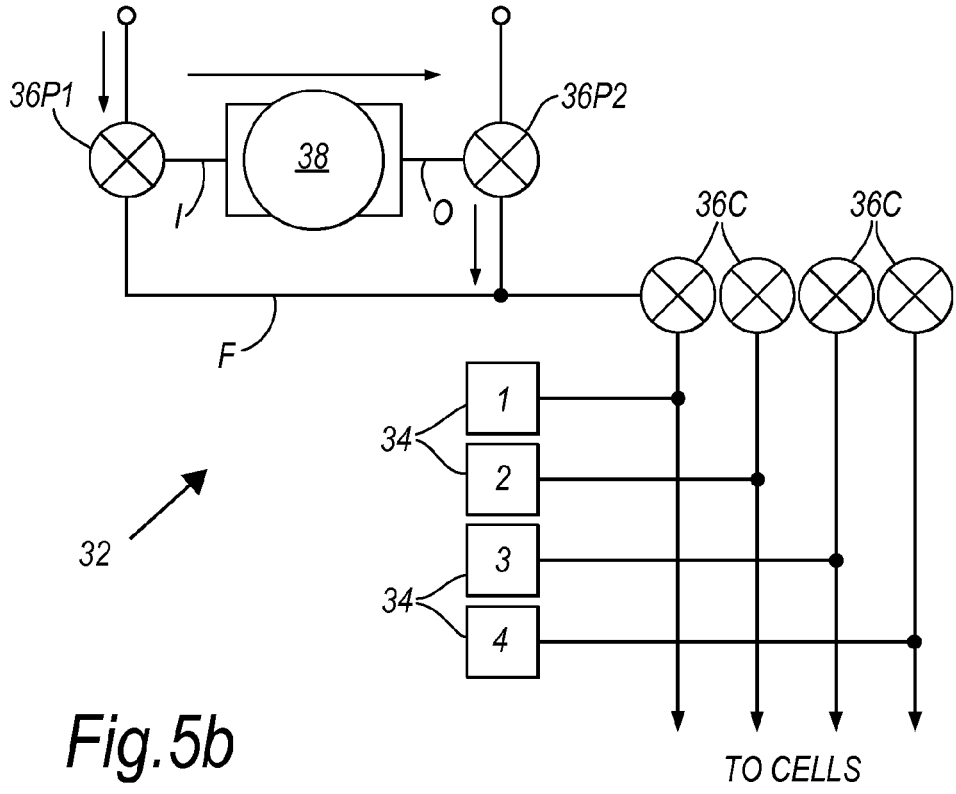
Figure 5C:
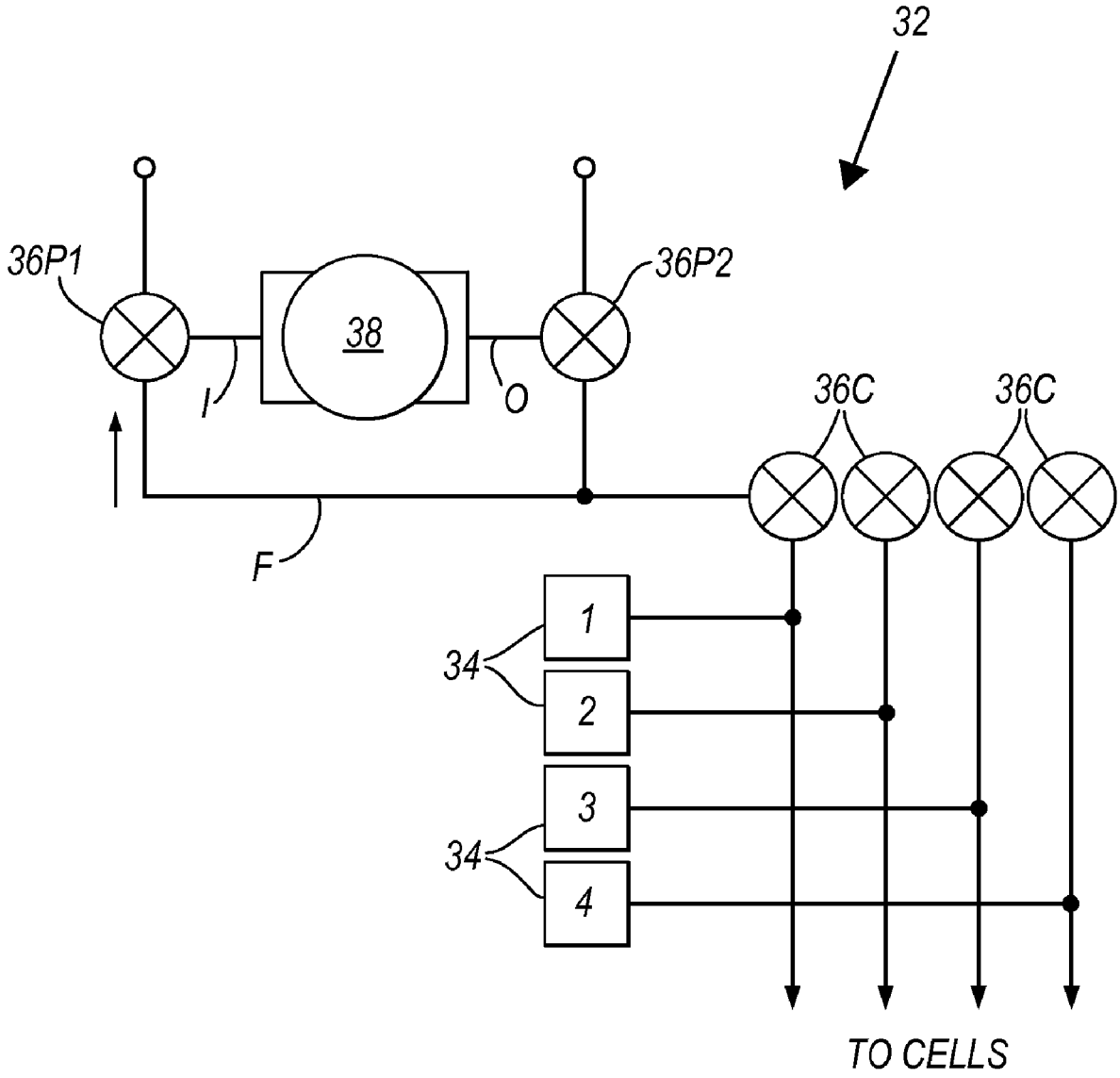

Still referring to FIG. 4, the control system associated with the compression device according to the second embodiment is similar to the control system of the compression device according to the first embodiment, except that there are four contact pressure sensors instead of only one contact pressure sensor. There is one pressure sensor associated with each cell of the sleeve 2. Referring to FIGS. 5*a* to 5*c*, the pump and valve arrangement 32 of the compression device of this embodiment includes six valves 36 and a pump 38 controlled by a microprocessor. The pump 38 has an inlet I and an outlet 0 and, together with an inlet valve 36P1 and an outlet valve 36P2, controls the air pressure in a fluid feed line F. The other valves are cell valves 36C associated with each cell and arranged to control the flow of air between the cells and the fluid feed line F. The pump valves 36P1, 36P2 each have a port connected to atmosphere and a port connected to the feed line F in addition to a port connected to the pump inlet I or outlet O. The pump valve 36P1 is able to connect the pump inlet I to the feed line F or to atmosphere. The pump valve 36P2 is able to connect the pump outlet O to the feed line F or to the atmosphere. The microprocessor is able to provide instructions to the pump 38 and pump valves and cell valves such that the pump 38 can be used to selectively inflate or deflate any one or more of the cells. This is achieved by selectively operating the pump valves 36P1, 36P2 to control direction of air flow to or from the fluid feed line F and controlling the cell valves 36C which are selectively opened or closed to allow flow of air to and from the individual cells. For each cell, the pressure sensors 34 are contact pressure sensors located on the surface of the sleeve.

The pump 38 is typically non-reversible and operates to pump air in a direction from its inlet I to its outlet O. Referring to FIG. 5*a*, when it is desired to draw air from the cells, the pump valve 36P1 is arranged to connect the pump inlet I to the fluid feed line F by the microprocessor and the pump valve 36P2 is arranged to connect the pump outlet O to atmosphere. This operation of the valves 36P1, 36P2 causes the air within the pump 38 and valve arrangement 32 to flow in the direction indicated by the arrows of FIG. 5*a*. Therefore, air is pumped away from the cells. Each one of the cell valves 36C can be operated individually under instruction from the microprocessor so that air may be drawn from one or more cells without being drawn from the other cells.

Referring to FIG. 5*b*, when it is desired to pump air to the cells, the first pump valve 36P1 is arranged to connect the pump inlet I to atmosphere and the second pump valve 36P2 is arranged to connect the pump outlet O to the fluid feed line F. Operation of the pump 38 then causes air to flow in the direction of the arrows shown in FIG. 5*b*, i.e., air is pumped towards the cells. Once again, the cell valves 36C can be individually operated by the microprocessor so that any one or more cells may be pumped up selectively.

Referring to FIG. 5*c*, when the cells are at a desired pressure, e.g., after they have been pumped up sufficiently for use in the continuous pressure mode, both pump valves 36P1 and 36P2 are arranged to connect the pump 38 to atmosphere so that the fluid in the fluid feed line F is at atmospheric pressure. The pump 38 does not operate and the air pressure inside the cells remains unchanged.

The compression device of the second embodiment is able to be selectively operated in a different mode to that previously described for the first embodiment. The compression device can also be operated in the same mode as previously described. In its different mode, the compression device can be used to provide intermittent pneumatic compression in which each of the cells is inflated in sequence, e.g., from the bottom of the leg upwards. Compliance data, i.e., data relating to use of the compression device, can be gathered by the microprocessor 28 (shown in FIG. 3) and stored in the memory 30 (also shown in FIG. 3). Using the user input 26, the healthcare professional can request that the gathered data stored in the memory 30 is displayed upon the display 21. In this embodiment, the display 21 is not part of the controller. Instead, the controller unit can communicate, e.g., via infrared communication, with a remote display screen (not shown). The displayed data includes data relating to the length of time for which each cell has been inflated while surrounding the limb at a particular pressure and in a particular mode, e.g., continuous constant pressure mode or intermittent pneumatic compression mode. The displayed data can also include data relating to the number of times which a patient has used the compression device within a set period, e.g., within the last week, two weeks, or since the last visit by the healthcare professional. The data can also include data relating to the actual time of day at which the compression device is used by a patient. The display data can also be analyzed and a display provided to indicate whether or not the compliance by the patient is good or bad. There may be a set threshold of use above which the compliance is good and below which it is bad. The displayed data which is available to the patient may be different than displayed data which is available to the healthcare professional—the healthcare professional may have access to more information upon entry of a password, PIN or other code using the user input 26.

Using the user input 26, it is possible for the healthcare professional to reset some or all of the data stored in the memory 30. This can be desirable between the visits of a healthcare professional to a patient for example. The healthcare professional may be required to enter a password, PIN or other code using the user input 26 before data stored in the memory 30 can be erased. The memory 30 can also store data on the date of the last reset. Thus, for instance, if the patient resets the memory, the date is recorded and at next visit the healthcare professional is presented with the reset date and the data collected since the reset.

A range of standard or expected inflation times are stored on the memory 30. Therefore, if the sleeve 2 is inflated while not in place on the limb, then the microprocessor 28 will recognize this by comparing data gathered from the pressure sensors 34 with data stored in the memory 30. For example, the time taken to reach a predetermined pressure value can be measured and, if it does not fall within an expected range, then the microprocessor 28 recognizes that the sleeve 2 is not in place on the limb and causes the pump and valve arrangement 32 to cease inflating the sleeve 2 and to deflate it instead. Data gathered by the sensors 34 whilst the sleeve 2 is not in place on the limb can also be discarded. The microprocessor can, therefore, determine, when the sleeve 2 is inflated, whether it is in place on the patient's limb or not. This ensures that data collected and stored relating to use of the compression device can accurately reflect correct use of the compression device when it is in place, and not be affected by inflation of the sleeve when the device is not in place on the patient.

Similarly a microprocessor 28 can recognize if the pump and valve arrangement 32 is attempting to inflate the sleeve 2, but the pressure measured by one or more of the pressure sensors 34 is not increasing correspondingly. In this situation, the microprocessor 28 recognizes that the sleeve 2 has a puncture and a suitable error message can be displayed on the display 21 to inform the user that there is a puncture in said one or more of the cells 22.

Although the present invention has been shown and described with respect to several preferred embodiments thereof, various changes, omissions and additions to the form and detail thereof, may be made therein, without departing from the scope of the invention. For example, the data relating to use may be available to any user without requiring entry of a PIN code. However, it may still be necessary to input a password, PIN, or other code before erasing information.

The intermittent pneumatic compression mode may be selectively available with a device substantially identical to the device of the first embodiment. Also the, or each, sensor may be a contact sensor, a pressure sensor or any other suitable type of sensor. Where more than one sensor is provided, combinations of different types of sensor may be used. For example, the contact pressure sensors of the second embodiment may be replaced by air pressure sensors located in the line between the cell and its associated valve 36. The sensor may be situated in the controller unit 8.

The controller unit 8 may not have a user input 26. Instead, for example, the system may receive inputs from, e.g., a keyboard of a personal computer or other processing device when it is in communication (e.g., infra-red) with it.

The invention claimed is:

1. A compression device for a limb of a patient comprising:

i. an inflatable sleeve arranged to surround the limb;

ii. a conduit attached to the sleeve arranged to deliver fluid to the sleeve;

iii. a control system arranged to control flow of fluid in the device; and iv. a memory arranged to store gathered data relating to the duration of use of the device wherein the compression device is arranged to detect whether the sleeve is in place surrounding the limb and the gathered data is dependent upon detection of whether the sleeve is in place surrounding the limb.

2. The compression device as claimed in claim 1, wherein the control system comprises a pump and a controller unit.

3. The compression device as claimed in claim 1, further comprising a display device arranged to provide a display dependent on the gathered data.

4. The compression device as claimed in claim 1, wherein the memory is also arranged to store data relating to pressure exerted by the sleeve on the limb.

5. The compression device as claimed in claim 1, wherein the memory is also arranged to store data relating to a mode of operation of the device.

6. The compression device as claimed in claim 5, wherein the mode of operation of the device selects a predetermined pressure profile for the sleeve.

7. The compression device as claimed in claim 1, comprising one or more pressure sensors arranged to determine when the pressure exerted by the sleeve on the limb has reached a predetermined value.

8. The compression device as claimed in claim 1, wherein the inflatable sleeve includes one or more cells and each cell has an associated pressure sensor arranged to determine the pressure exerted by the cell.

9. The compression device as claimed in claim 8, wherein the one or more pressure sensors each comprises a fluid pressure sensor arranged to measure fluid pressure.

10. The compression device as claimed in claim 8, wherein the one or more pressure sensors each comprises an air pressure sensor arranged to measure the contact pressure between the sleeve and the limb.

11. The compression device as claimed in claim 1, wherein expected data values relating to use of the device are also stored in the memory.

12. The compression device as claimed in claim 11, wherein the control system is arranged to compare gathered data with expected data and thereby detect an error if the sleeve is not in place surrounding the limb, if there is an error in the device or if there is a puncture in the sleeve.

13. The compression device as claimed in claim 12, wherein the control system is arranged to determine whether the sleeve surrounds the limb by monitoring a change in pressure exerted by the sleeve as it is inflated.

14. The compression device as claimed in claim 13, wherein the control system is arranged to shut off delivery of fluid to the sleeve if it is determined that the sleeve is not in place surrounding the limb.

15. The compression device as claimed in claim 3 further comprising user input means arranged to receive a user input to cause the display dependent upon the gathered data to be displayed.

16. The compression device as claimed in claim 1, wherein the compression device is for the limb of a mobile patient.

17. A method of monitoring use of a compression device for a limb of a patient, said compression device comprising an inflatable sleeve arranged to surround the limb; a conduit attached to the sleeve arranged to deliver fluid to the sleeve; and a control system arranged to control flow of fluid in the compression device, comprising the step of storing gathered data relating to the duration of use of the compression device wherein the compression device is arranged to detect whether the sleeve is in place surrounding the limb and the gathered data is dependent upon detection of whether the sleeve is in place surrounding the limb.

18. The method of claim 17 further comprising the step of displaying information relating to the gathered data.

19. The method of claim 17, wherein the step of storing gathered data occurs with a data carrier carrying software which, when run on a processor of a control system of the compression device, is arranged to monitor use of the device.

20. A method of treating venous leg ulcers, venous insufficiency or deep vein thrombosis comprising applying a compression device to a limb of a patient, said compression device comprising an inflatable sleeve arranged to surround the limb; a conduit attached to the sleeve arranged to deliver fluid to the sleeve; and a control system arranged to control the flow of fluid in the compression device, gathering data relating to the duration of use of the compression device, and storing the data in a memory wherein the compression device is arranged to detect whether the sleeve is in place surrounding the limb and the gathered data is dependent upon detection of whether the sleeve is in place surrounding the limb.

* * * * *